US008333373B2

(12) United States Patent
Okuchi et al.

(10) Patent No.: US 8,333,373 B2
(45) Date of Patent: Dec. 18, 2012

(54) IMAGE FORMING APPARATUS WITH METAL TRANSPORT CHUTE AND RESIN SUPPORT FRAME

(75) Inventors: Hiroyuki Okuchi, Nagoya (JP); Yoshikazu Shimizu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 326 days.

(21) Appl. No.: 12/719,029

(22) Filed: Mar. 8, 2010

(65) Prior Publication Data

US 2010/0244358 A1 Sep. 30, 2010

(30) Foreign Application Priority Data

Mar. 24, 2009 (JP) ..... 2009-072210

(51) Int. Cl.
*B65H 5/26* (2006.01)

(52) U.S. Cl. ..... 271/9.09; 399/392

(58) Field of Classification Search ..... 271/9.09, 271/9.12, 9.13; 399/392
See application file for complete search history.

(56) References Cited

U.S. PATENT DOCUMENTS

| | | | | |
|---|---|---|---|---|
| 4,744,687 | A * | 5/1988 | Nukaya et al. | 271/9.12 |
| 7,062,216 | B2 * | 6/2006 | Nobe et al. | 399/392 |
| 7,382,998 | B2 * | 6/2008 | Murrell | 399/392 |
| 2006/0267269 | A1 | 11/2006 | Yano et al. | |
| 2007/0147875 | A1 | 6/2007 | Hattori | |
| 2008/0219732 | A1 | 9/2008 | Hattori | |

FOREIGN PATENT DOCUMENTS

| | | | |
|---|---|---|---|
| JP | 03111352 | A * | 5/1991 |
| JP | 2006-176320 | | 7/2006 |
| JP | 2006-315797 | | 11/2006 |
| JP | 2007-169024 | | 7/2007 |
| JP | 2008-058388 | | 3/2008 |
| JP | 2008-174390 | | 7/2008 |

* cited by examiner

*Primary Examiner* — Gerald McClain

(74) *Attorney, Agent, or Firm* — Banner & Witcoff, Ltd.

(57) ABSTRACT

An image forming apparatus includes an image forming unit, a housing including a sheet feed opening for feeding a recording sheet to the image forming unit, a tray which accommodates a recording sheet, and a feed member which rotates while pressing a recording sheet fed through the sheet feed opening to apply a transport force to the recording sheet. Also, the image forming apparatus may include a friction member provided to oppose the feed member, and contact the recording sheet from a side opposite to the feed member to apply a transport resistance to the recording sheet, a resin support frame which supports the friction member, and a metal transport chute which includes a guide part provided to contact the recording sheet fed from the tray to guide the recording sheet toward the image forming unit, the transport chute being formed integrally with the support frame.

7 Claims, 18 Drawing Sheets

XIII-XIII SECTION

IMAGE FORMING APPARATUS WITH METAL TRANSPORT CHUTE AND RESIN SUPPORT FRAME

CROSS-REFERENCE TO RELATED APPLICATION

This application claims priority from Japanese Patent Application No. 2009-072210, filed on Mar. 24, 2009, the entire subject matter of which is incorporated herein by reference.

TECHNICAL FIELD

Aspects of the present invention relate to an image forming apparatus having a multi-purpose sheet feed tray or a sheet feed opening.

BACKGROUND

An image forming apparatus is configured such that, a recording sheet such as a sheet or the like is fed to an image forming unit from a multi-purpose sheet feed tray (hereinafter, referred to as MP tray), such as a manual tray or the like, in addition to a sheet feed tray (sheet feed cassette) mounted in a housing.

The image forming apparatus is provided with a sheet feed mechanism configured to separate and feed a plurality of sheets placed in the MP tray one by one to the image forming unit. Specifically, the sheet feed mechanism includes a sheet feed roller configured to rotate while pressing the sheet, a separation pad configured to contact the sheet from a side opposite to the sheet feed roller, and the like.

In the sheet feed mechanism, a plurality of stacked sheets are pressed by the sheet feed roller toward the separation pad, and friction occurs between the separation pad and sheets in contact with the separation pad, so that only a sheet in contact with the sheet feed roller can be fed.

In this sheet feed mechanism, if a support frame supporting the separation pad is bent greatly due to a pressing force of the sheet feed roller which presses the sheets toward the separation pad, an actual pressing force decreases, and a friction which is occurring between the sheets and the separation pad decreases. In this case, a function (hereinafter, referred to as separation and feed function) to separate and feed a plurality of sheets placed in the MP tray one by one to the image forming unit would deteriorate.

If the support frame is formed of resin, the separation and feed function would remarkably deteriorate. This problem can be solved by using resin having high mechanical strength, but the use of such resin having high mechanical strength causes an increase in manufacturing cost of the support frame (image forming apparatus).

SUMMARY

Accordingly, it is an aspect of the present invention to provide an image forming apparatus which prevents a separation and feed function from deteriorating while suppressing an increase in manufacturing cost of a support frame (image forming apparatus).

According to an illustrative embodiment of the present invention, there is provided an image forming apparatus comprising: an image forming unit which is configured to form an image on a recording sheet; a housing which accommodates the image forming unit and includes a sheet feed opening for feeding a recording sheet to the image forming unit; a tray which is configured to accommodate a recording sheet; a feed member which is configured to rotate while pressing a recording sheet fed through the sheet feed opening to apply a transport force to the recording sheet; a friction member provided to oppose the feed member, and configured to contact the recording sheet from a side opposite to the feed member to apply a transport resistance to the recording sheet, thereby separating a plurality of stacked recording sheets; a support frame which is formed of resin and supports the friction member and extends in a direction substantially perpendicular to a pressing direction of a pressing force by the feed member to receive the pressing force; and a transport chute which is formed of metal and includes a guide part extending along a width direction of a recording sheet transported from the tray in a direction parallel to a longitudinal direction of the support frame so as to contact the recording sheet fed from the tray to guide the recording sheet toward the image forming unit, the transport chute being formed integrally with the support frame.

According to another illustrative embodiment of the present invention, there is provided an image forming apparatus comprising: a housing which includes a sheet feed opening; a sheet feed tray which is accommodated in the housing; an image forming unit which is accommodated in the housing and is configured to form an image on a recording sheet; a feed member which is configured to rotate; a friction member provided to oppose the feed member and urged toward the feed roller, wherein a recording sheet provided though the sheet feed opening is fed toward the image forming unit between the feed member and the friction member; a support frame which is formed of resin and supports the friction member; a transport unit which is configured to feed and transport a recording sheet from the sheet feed tray; and a metal member which is formed of metal and includes a guide part configured to contact and guide the recording sheet transported by the transport unit from the sheet feed tray toward the image forming unit, the metal member being formed integrally with the support frame.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Hereinafter, an electrophotographic image forming apparatus will be described as an example of an image forming apparatus according to an illustrative embodiment of the present invention with reference to the drawings.

1. Schematic Configuration of Image Forming Apparatus

Figure 1:
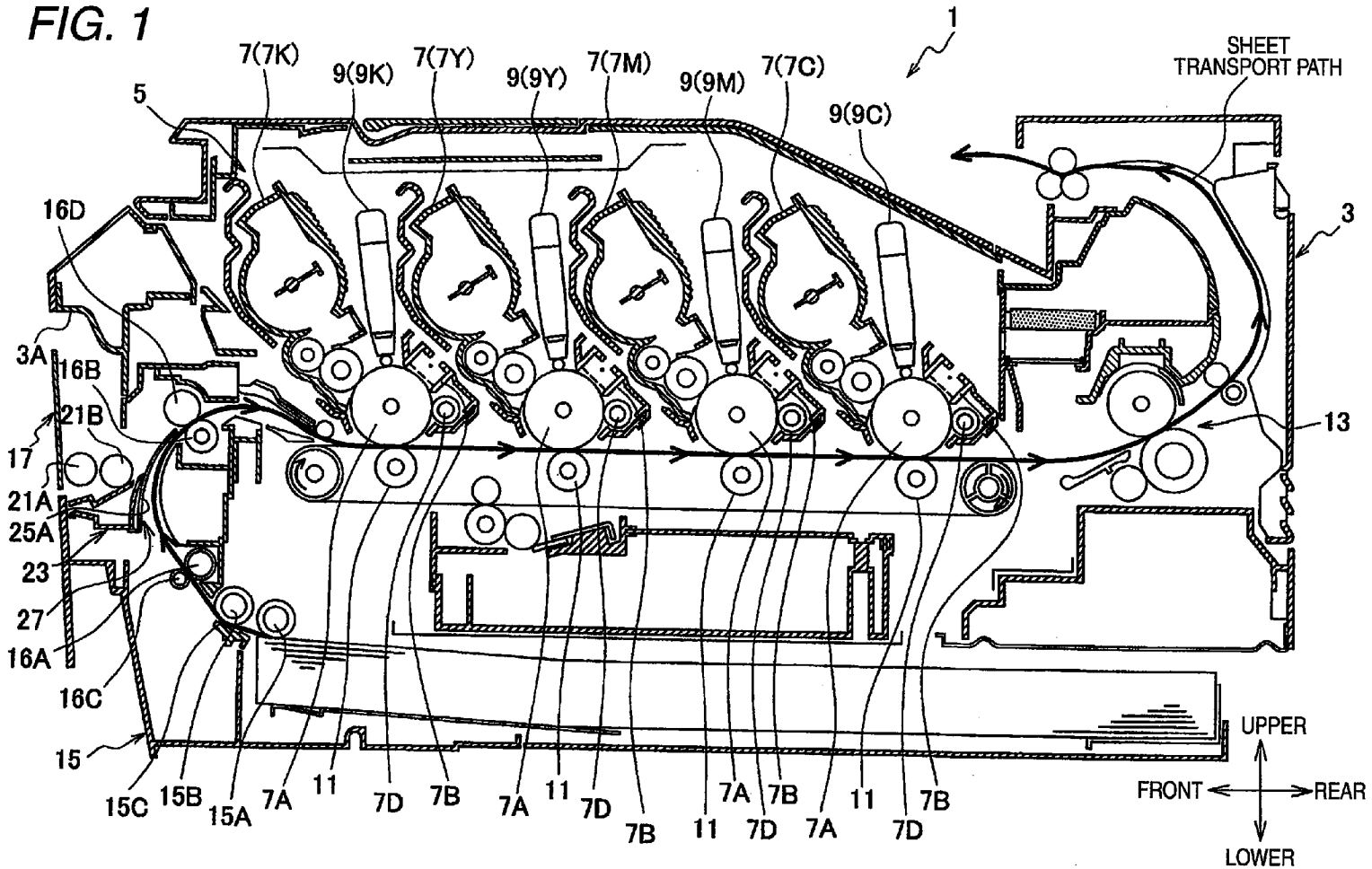
FIG. 1 is a schematic view showing a section of an image forming apparatus according to an illustrative embodiment of the present invention.

As shown in FIG. 1, an image forming apparatus 1 includes a housing 3, an electrophotographic image forming unit 5 accommodated in the housing 3. The image forming unit 5 is configured to transfer a developer image to a recording sheet (hereinafter, referred to as a sheet), such as recording paper or an OHP sheet or the like, thereby forming an image on the sheet.

The image forming unit 5 includes a process cartridge 7, an exposure unit 9 configured to expose a photosensitive drum 7A, a transfer roller 11 configured to transfer a developer image formed on the photosensitive drum 7A to a sheet, a fixing unit 13 configured to heat and fix the developer image transferred to the sheet, and the like.

The image forming unit 5 according to this illustrative embodiment is a direct tandem type and includes a plurality of process cartridges 7K, 7Y, 7M and 7C (in this illustrative embodiment, four process cartridges) provided in parallel with each other and arranged along a sheet transport direction, and a plurality of kinds of developer images are transferred directly to the sheet.

Each of the process cartridges 7K, 7Y, 7M and 7C includes a photosensitive drum 7A configured to carry a developer image thereon, a charger 7B configured to charge the photosensitive drum 7A, a cleaner 7D configured to clean the surface of the photosensitive drum 7A having the transferred developer image, and the like.

The exposure unit 9 includes four exposure units 9K, 9Y, 9M and 9C corresponding to the process cartridges 7K, 7Y, 7M and 7C. Each of the exposure units 9K to 9C has multiple LEDs arranged in a direction parallel to the width direction of the photosensitive drum 7A, and is configured to expose the photosensitive drum 7A by controlling the lighting of the LEDs.

A sheet feed cassette 15 is a tray in which sheets to be transported to the image forming unit 5 are stacked. The sheet feed cassette 15 is detachably mounted in an apparatus main body (housing 3).

The sheets in the sheet feed cassette 15 are transported by a pickup roller 15A, separated one by one by a separation roller 15B and a separation pad 15C, and transported to the image forming unit 5.

After a sheet separated and discharged by the separation roller 15B is given a transport force by a transport roller 16A, the transport direction of the sheet turns upward at about 180 degrees by a guide part 27A which is configured to contact the sheet so as to guide transport of the sheet toward the image forming unit 5.

The sheet that is guided and turned upward by the guide part 27A is transported to the image forming unit 5 after skew is corrected by a registration roller 16B provided on a downstream side in the transport direction from the guide part 27A. The pinch roller 16C and the pinch roller 16D are configured to press the sheet against the transport roller 16A and the registration roller 16B, respectively.

In this illustrative embodiment, both the pinch rollers 16C and 16D are frictionally charged to generate static electricity, such that foreign substances (hereinafter, simply referred to paper dust), such as paper dust or the like, sticking onto the sheet are absorbed and collected on both the pinch rollers 16C and 16D. Therefore, in this illustrative embodiment, both the pinch rollers 16C and 16D also function as paper dust removing rollers.

Figure 2:
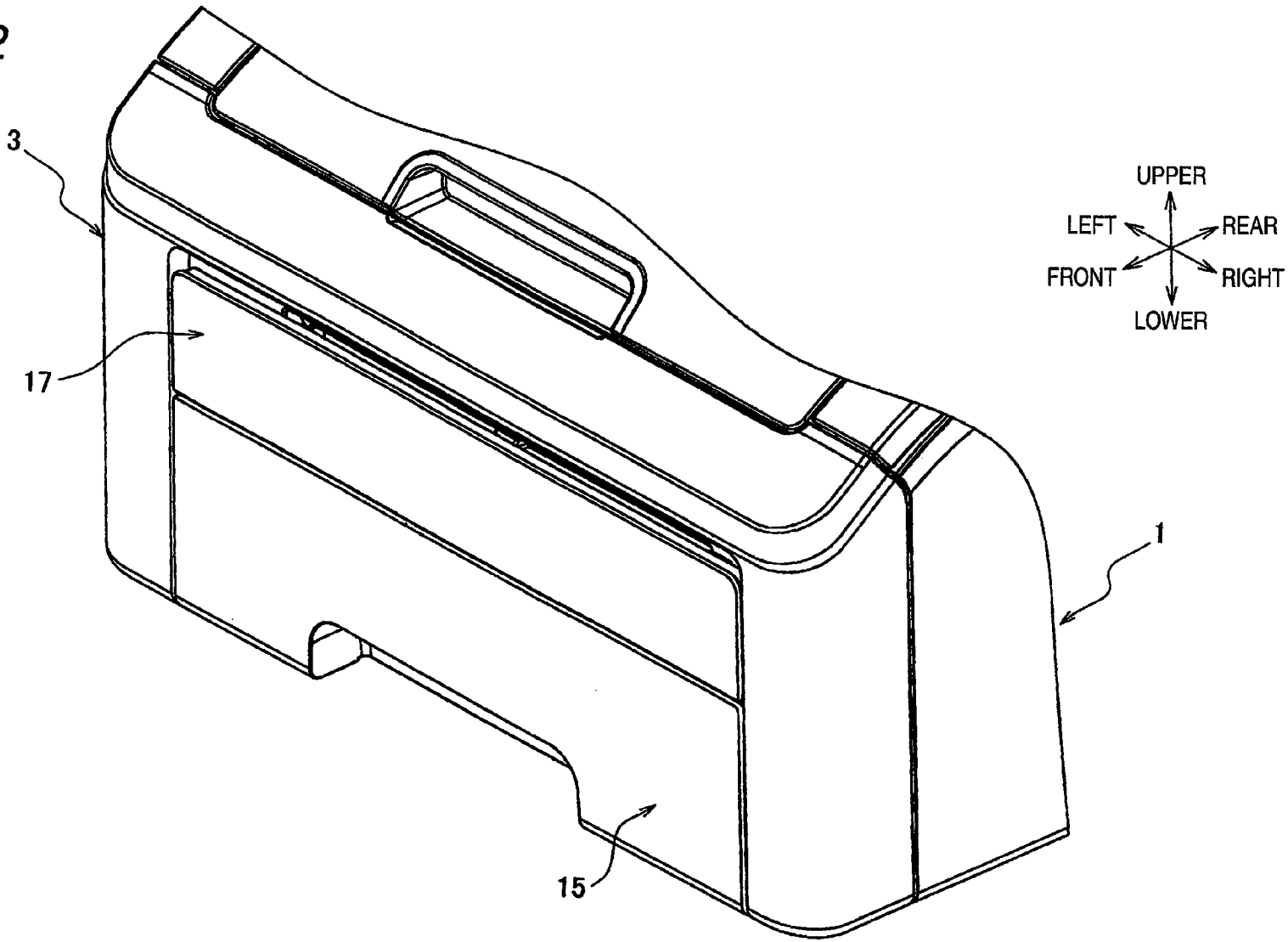
FIG. 2 is a perspective view showing a front surface side of the image forming apparatus according to the illustrative embodiment of the present invention.

A sheet feed opening 3A is provided at a front part on a side surface of the housing 3 to directly feed a sheet other than the sheets placed in the sheet feed cassette 15 to the image forming unit 5. At the time of normal use, the sheet feed opening 3A is closed by a multi-purpose sheet feed tray (hereinafter, referred to as MP tray) 17, such as a manual tray or the like, which is pivotably provided to the housing 3 (see FIG. 2). Herein, the term "normal use" refers to a case where a sheet is fed from the sheet feed cassette 15.

Figure 3:
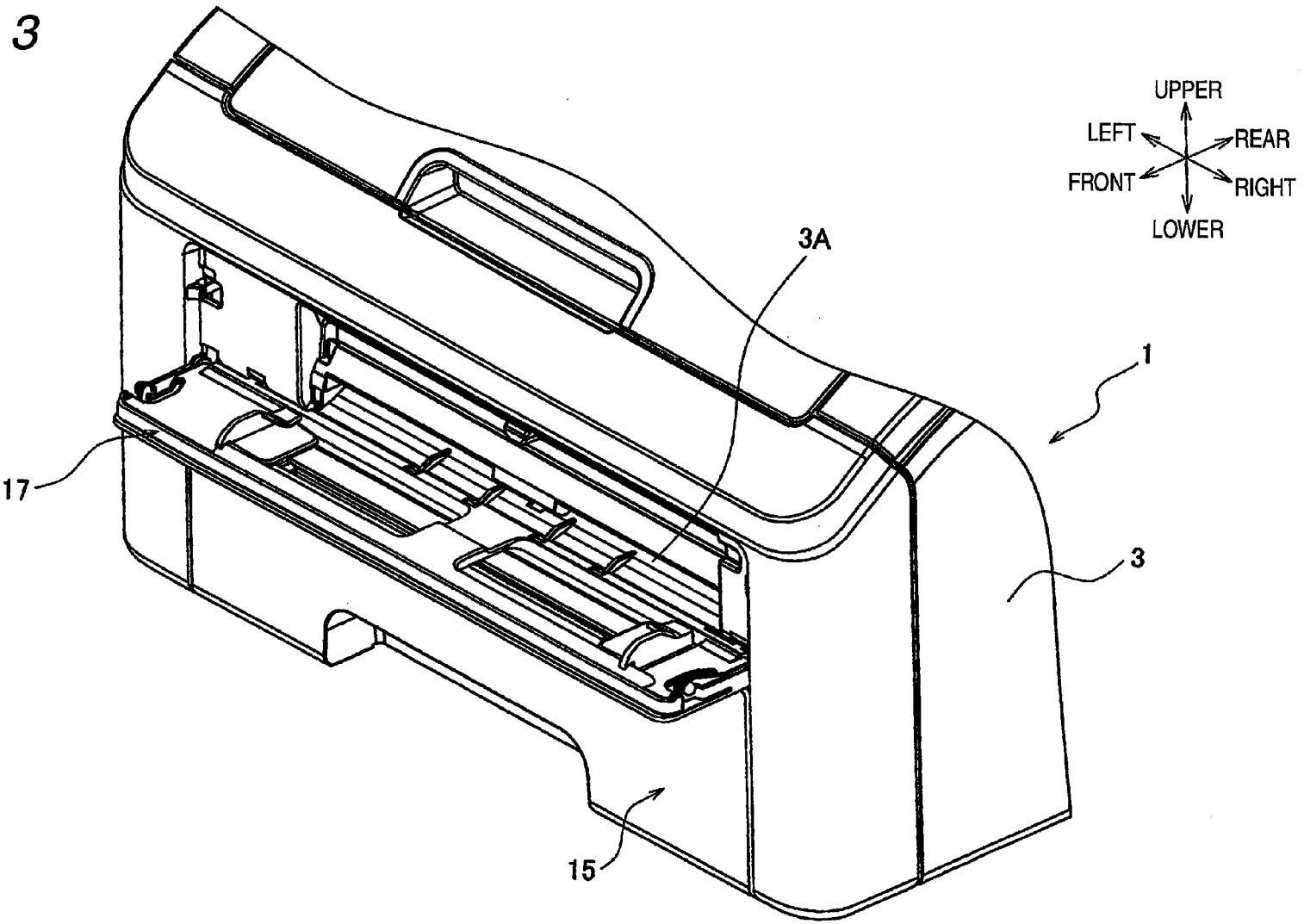
FIG. 3 is a perspective view showing the image forming apparatus according to the illustrative embodiment of the present invention in a state where an MP tray is open.

If the MP tray 17 is opened toward the front side, as shown in FIG. 3, the sheet feed opening 3A is opened, and a sheet can be fed from the sheet feed opening 3A. In this state, the MP tray 17 functions as a guide member of a sheet fed through the sheet feed opening 3A.

Figure 4:
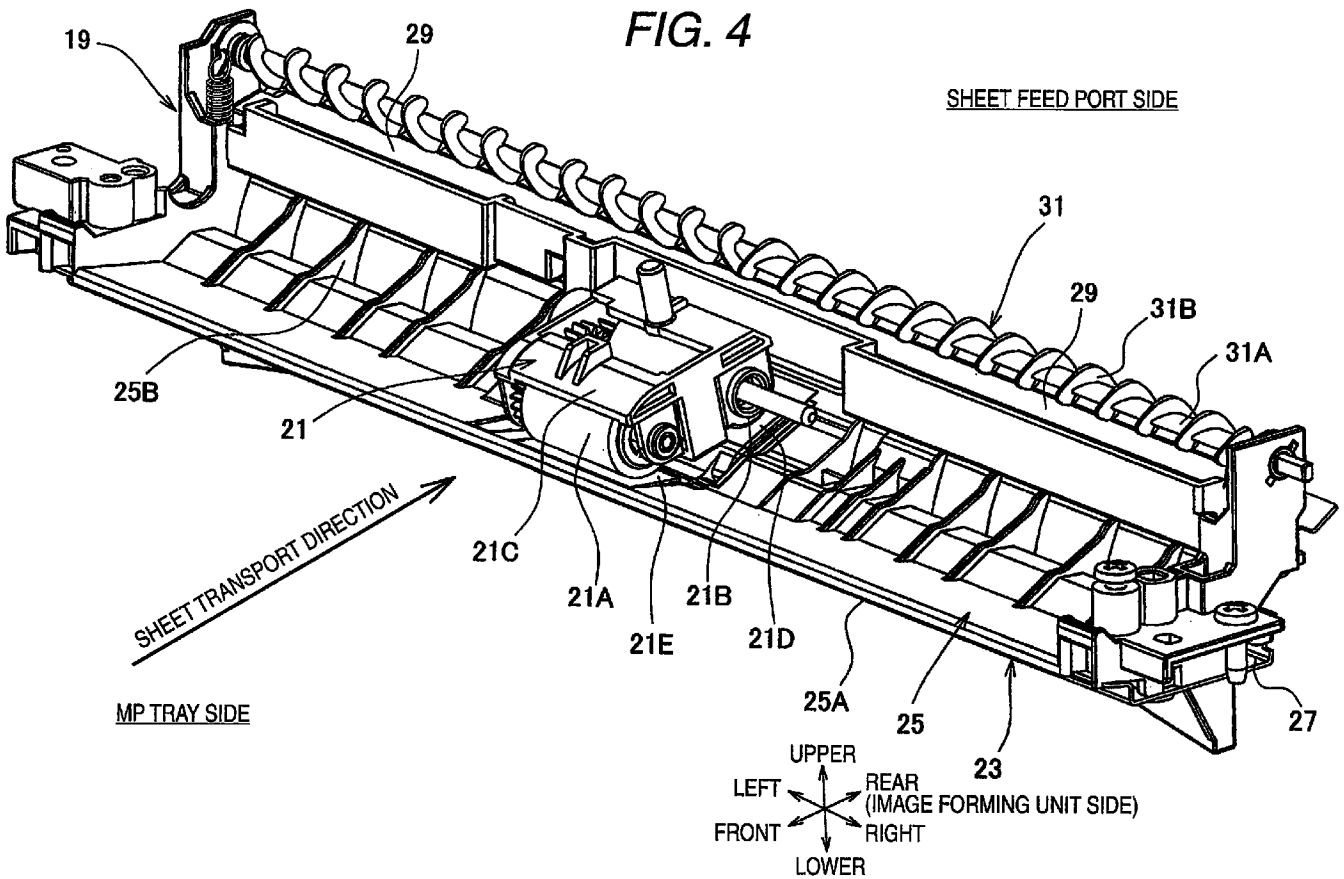
FIG. 4 is a perspective view showing a sheet feed unit according to the illustrative embodiment of the present invention.
Figure 5:
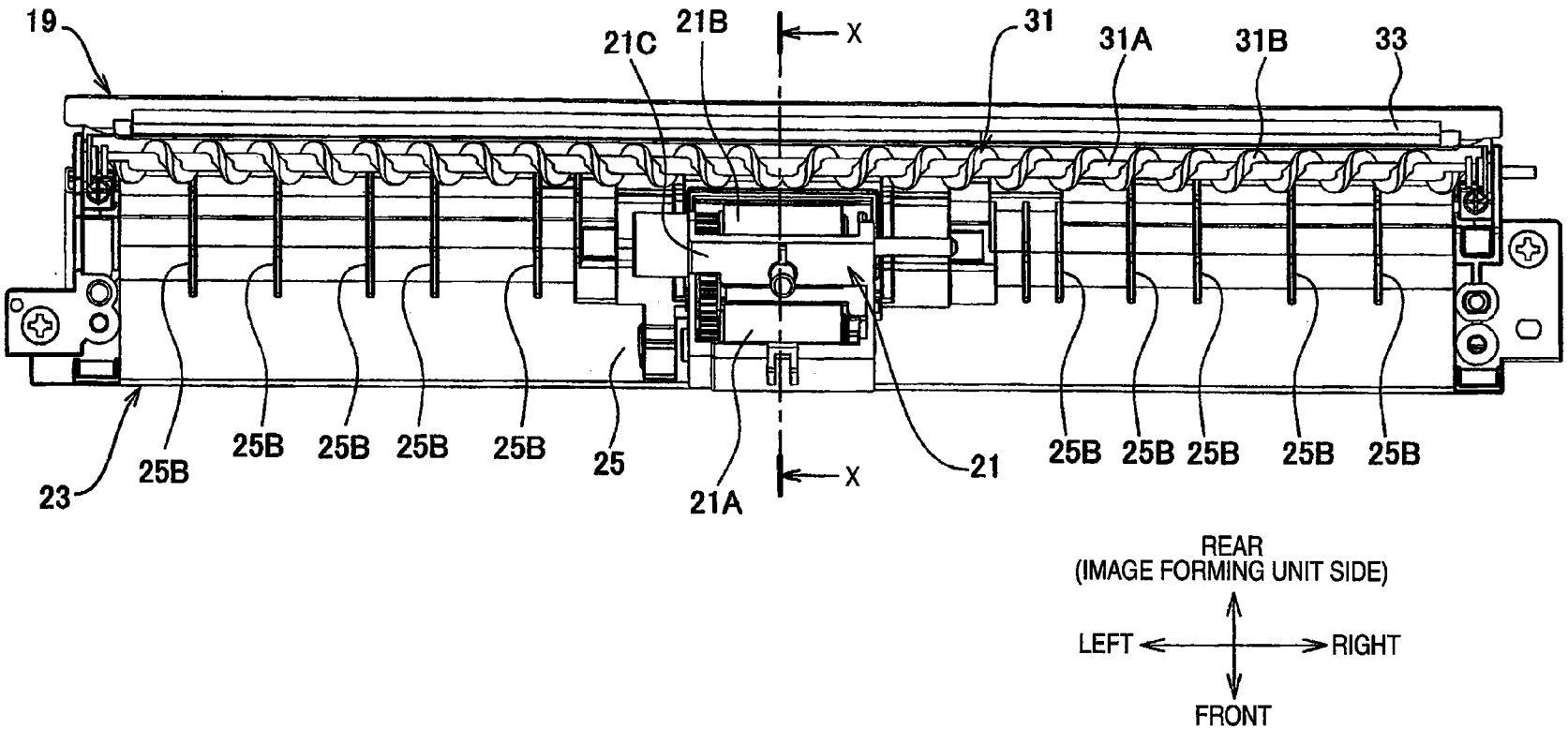
FIG. 5 is a top view of the sheet feed unit according to the illustrative embodiment of the present invention.
Figure 6:
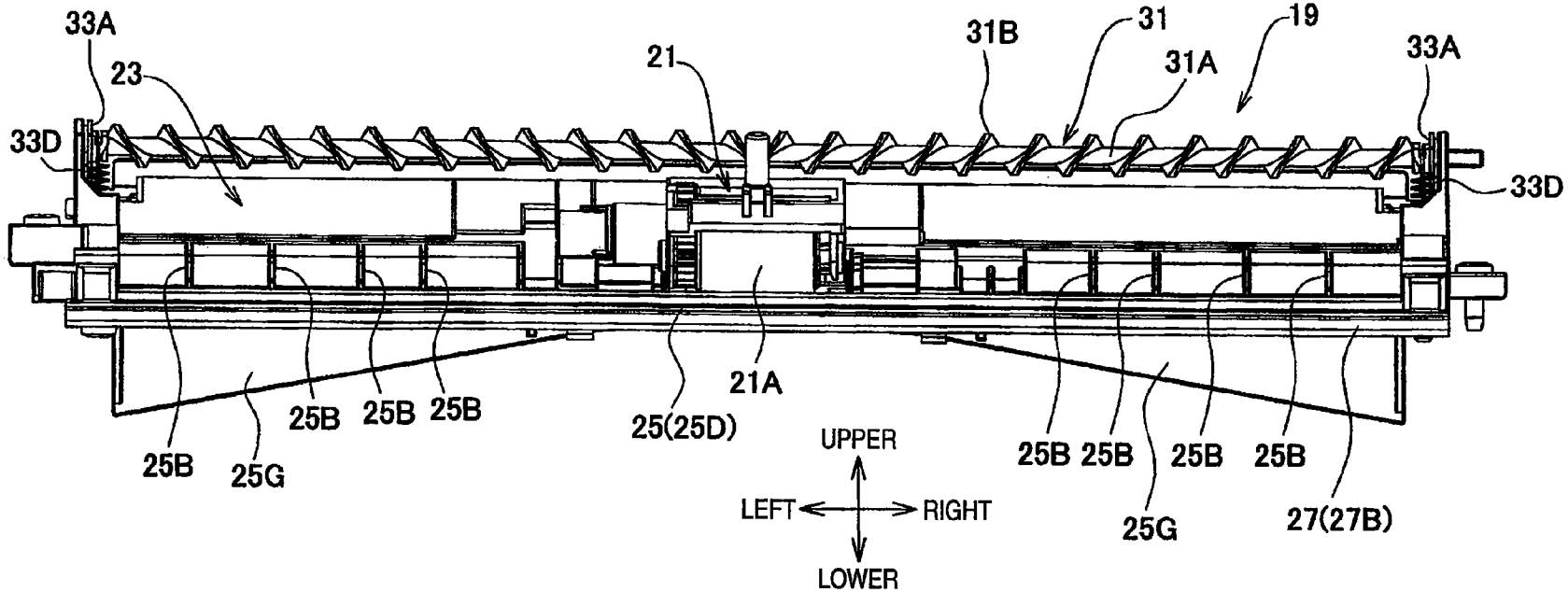
FIG. 6 is a front view of the sheet feed unit according to the illustrative embodiment of the present invention when viewed from the MP tray side.
Figure 10:
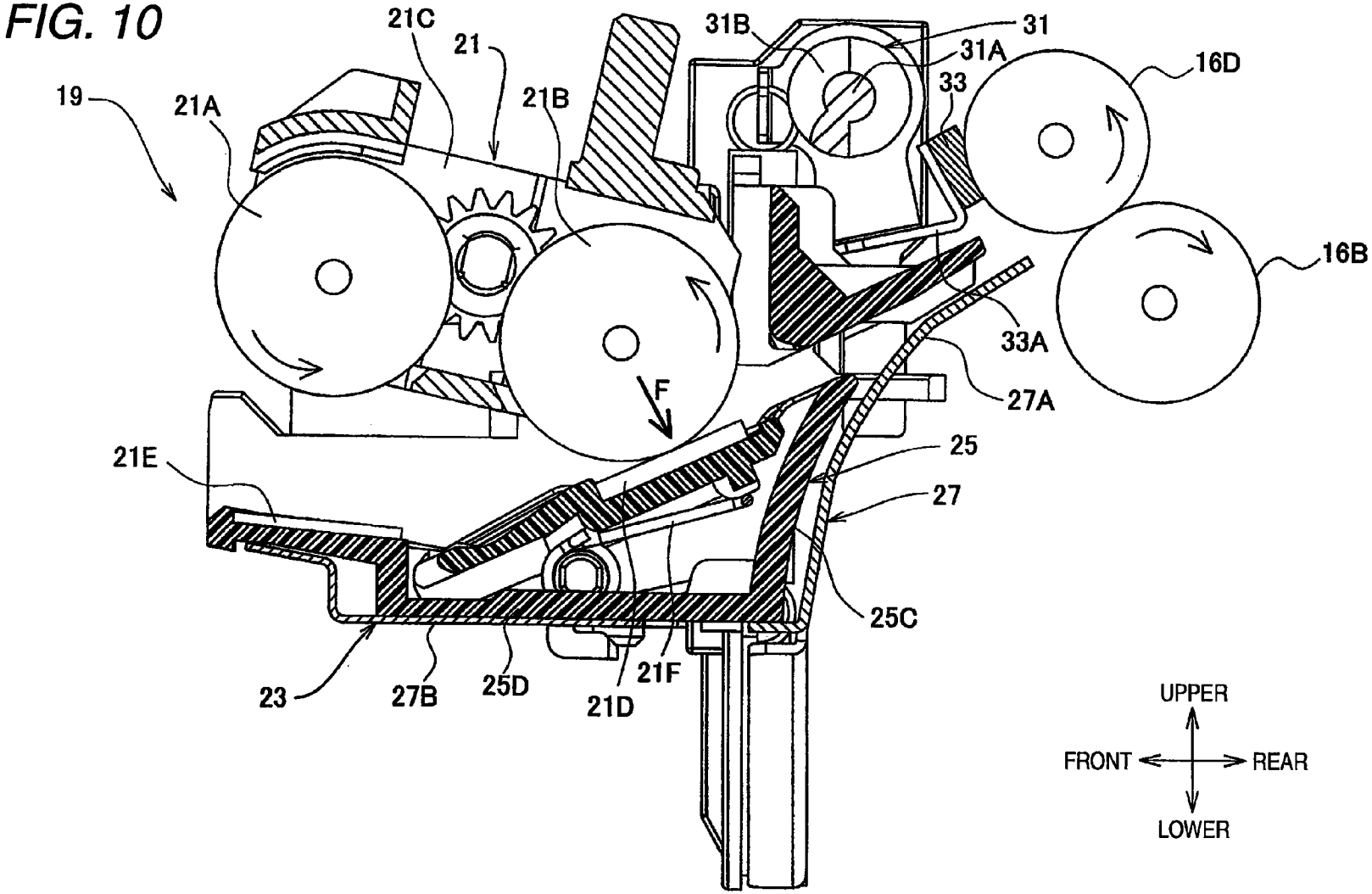
FIG. 10 is a sectional view including a registration roller, a pinch roller according to the illustrative embodiment of the present invention taken along the line X-X of FIG. 5.

2. Configuration for Feeding Sheet from Sheet Feed Opening to Image Forming Unit Inside the housing 3, a sheet feed unit 19 shown in FIGS. 4 to 6 is provided at the lower end of the sheet feed opening 3A. The sheet feed unit 19 includes a feed unit 21 configured to feed the sheets placed on the MP tray 17 as shown in FIG. 10, a frame unit 23, and the like.

The feed unit 21 includes a pickup roller 21A configured to rotate while contacting a sheet placed on the MP tray 17 to send the sheet, a separation roller 21B configured to rotate while pressing the sheet sent from the pickup roller 21A downward to apply a frictional force to the sheet and to feed the sheet through the sheet feed opening 3A, a roller holder 21C which rotatably holds both the rollers 21A and 21B, and the like.

The operation of the feed unit 21 at the time of sheet feeding is similar to a relater-art (for example, see JP-A-2006-

315797, which is incorporated herein by reference). Accordingly, in this specification, detailed description of the operation of the feed unit 21 will be omitted.

The frame unit 23 includes a support frame 25 (see FIG. 4) and a transport chute 27 and the like. The support frame 25 is formed of resin such as polystyrene, and extends in a direction corresponding to a left-right direction of the image forming apparatus 1 in the illustrative embodiment, which is substantially perpendicular to a pressing direction of a pressing force F by the separation roller 21B so as to receive the pressing force F. The transport chute 27 is formed of metal such as a cold rolled steel plate in the illustrative embodiment and fixed to the support frame 25. The metal used in the transport chute 27 is more rigid than the resin used in the support frame 25

2.1. Configuration of Support Frame

Figure 11:
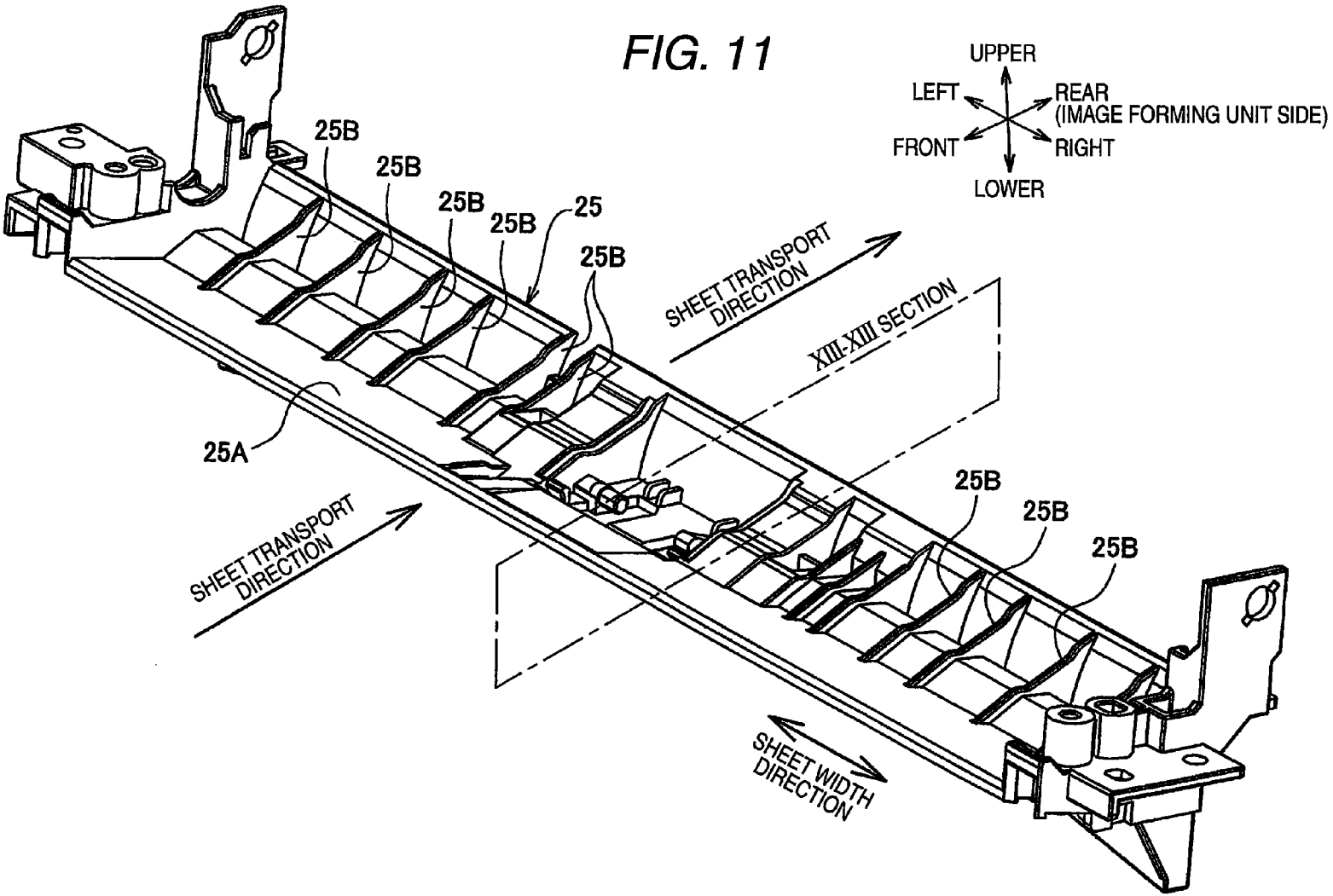
FIG. 11 is a perspective view of a support frame according to the illustrative embodiment of the present invention.

As shown in FIG. 11, the support frame 25 has a beam portion 25A which extends in the left-right of the image forming apparatus 1, that is, in the width direction of a sheet transported from the sheet feed cassette 15. The beam portion 25A has a plurality of guide ribs 25B which are formed integrally with the beam portion 25A to reinforce the beam portion 25A and are configured to contact a sheet being transported at the upper end thereof, thereby guiding the sheet toward the sheet feed opening 3A.

Figure 13:
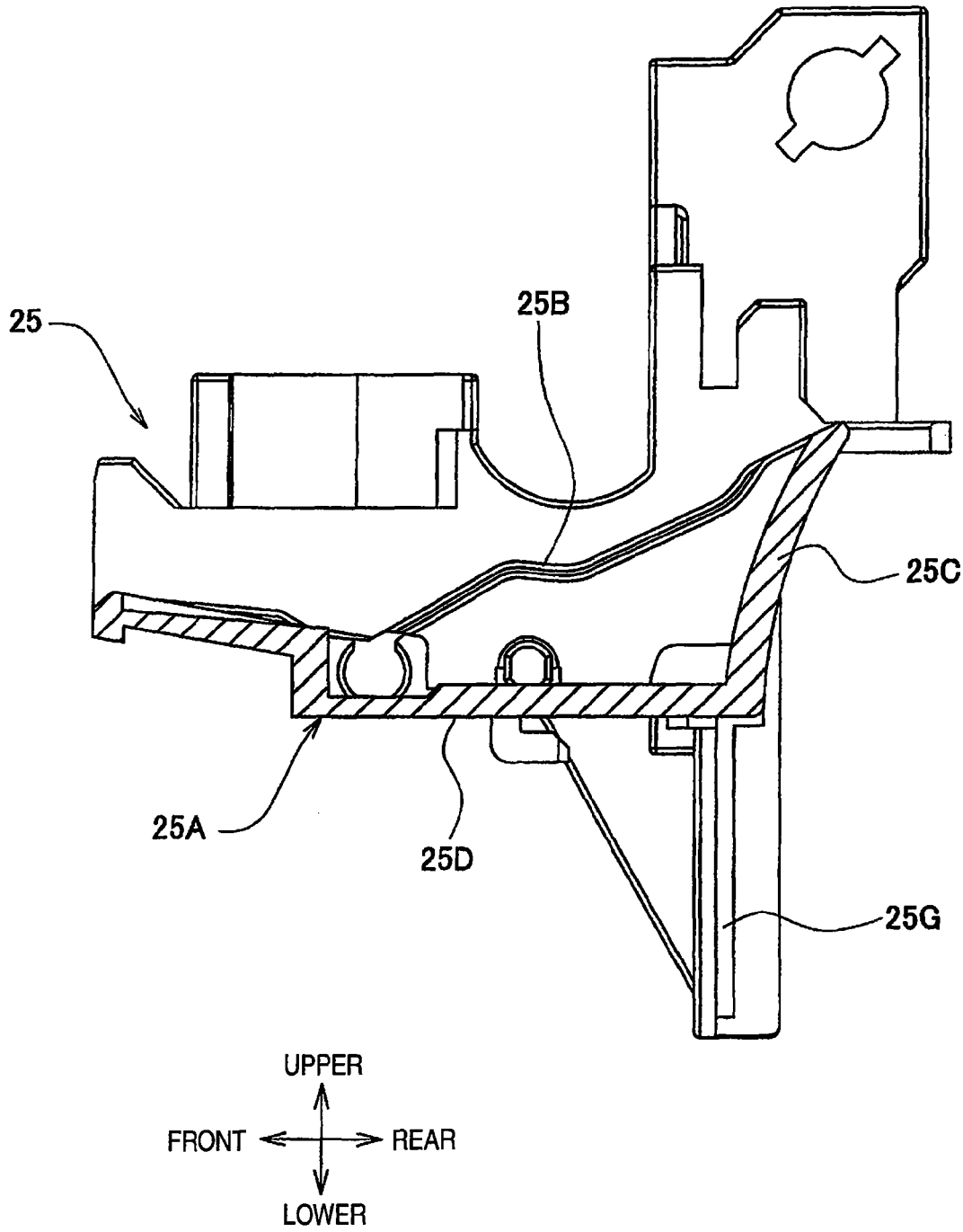
FIG. 13 is a sectional view of the support frame according to the illustrative embodiment of the present invention taken along the line XIII-XIII of FIG. 11.

As shown in FIG. 10, the beam portion 25A has a substantially L-shape section (see a shaded portion of FIG. 13). The beam portion 25A includes an upright portion 25C, a horizontal portion 25D and the like. The upright portion 25C is positioned on an opposite surface side of the guide part 27A and substantially upright in a vertical direction. The horizontal portion 25D extends in a horizontal direction so as to be substantially perpendicular to the upright portion 25C and is configured to receive the pressing force F.

Accordingly, when viewed from the width direction, the guide direction of a sheet by the transport chute 27 (guide part 27A) intersects the transport direction of a sheet by the separation roller 21B. In other words, the transport direction of a sheet transported from the sheet feed cassette 15 intersects the transport direction of a sheet transported from the MP tray 17 so as to join together around the pinch roller 16D.

At a substantially central portion of the horizontal portion 25D in a longitudinal direction (left-right direction), that is, at a position corresponding to the feed unit 21, a separation pad 21D and a friction plate 21E are provided. While the friction plate 21E is immovably fixed to the horizontal portion 25D, the separation pad 21D is fixed to the horizontal portion 25D through an elastic member, such as a torsion spring 21F or the like. Accordingly, the separation pad 21D is constantly pressed (urged) toward the separation roller 21B by an elastic force of the torsion spring 21F.

The separation pad 21D is a friction member which is configured to contact a sheet from a side opposite to the separation roller 21B with the sheet being transported sandwiched therebetween and applies predetermined transport resistance (friction) to the sheet to separate a plurality of stacked sheets. The friction plate 21E is configured to contact a sheet from a side opposite to the pickup roller 21A to prevent multiple sheets from being fed to the separation roller 21B.

As shown in FIG. 4, on a side opposing the sheet feed opening 3A, the beam portion 25A includes a paper dust storage portion 29 configured to store paper dust, and an auger 31 configured to transfer (transport) paper dust collected (removed) from the pinch roller 16D to the paper dust storage portion 29. In this illustrative embodiment, the paper dust storage portion 29 is detachably attached to the support frame 25, so that paper dust stored in the paper dust storage portion 29 can be easily discarded.

The auger 31 is a screw pump type powder transfer pump, and includes a rotation shaft 31A extending in the width direction (the longitudinal direction of the beam portion 25A) and a spiral blade 31B provided on the peripheral surface of the rotation shaft 31A. Both ends of the auger 31 (rotation shaft 31A) in the longitudinal direction are rotatably supported by both ends of the beam portion 25A in the longitudinal direction.

As shown in FIG. 10, a paper dust removing portion 33 is provided around the auger 31. The paper dust removing portion 33 is configured to contact the peripheral surface of the pinch roller 16D to scrape paper dust absorbed and collected on the peripheral surface thereof. Paper dust scraped by the paper dust removing portion 33 is transferred to the paper dust storage portion 29 by the auger 31. In this illustrative embodiment, the paper dust removing portion 33 is formed of a porous elastic member, such as sponge or the like.

Figure 7:
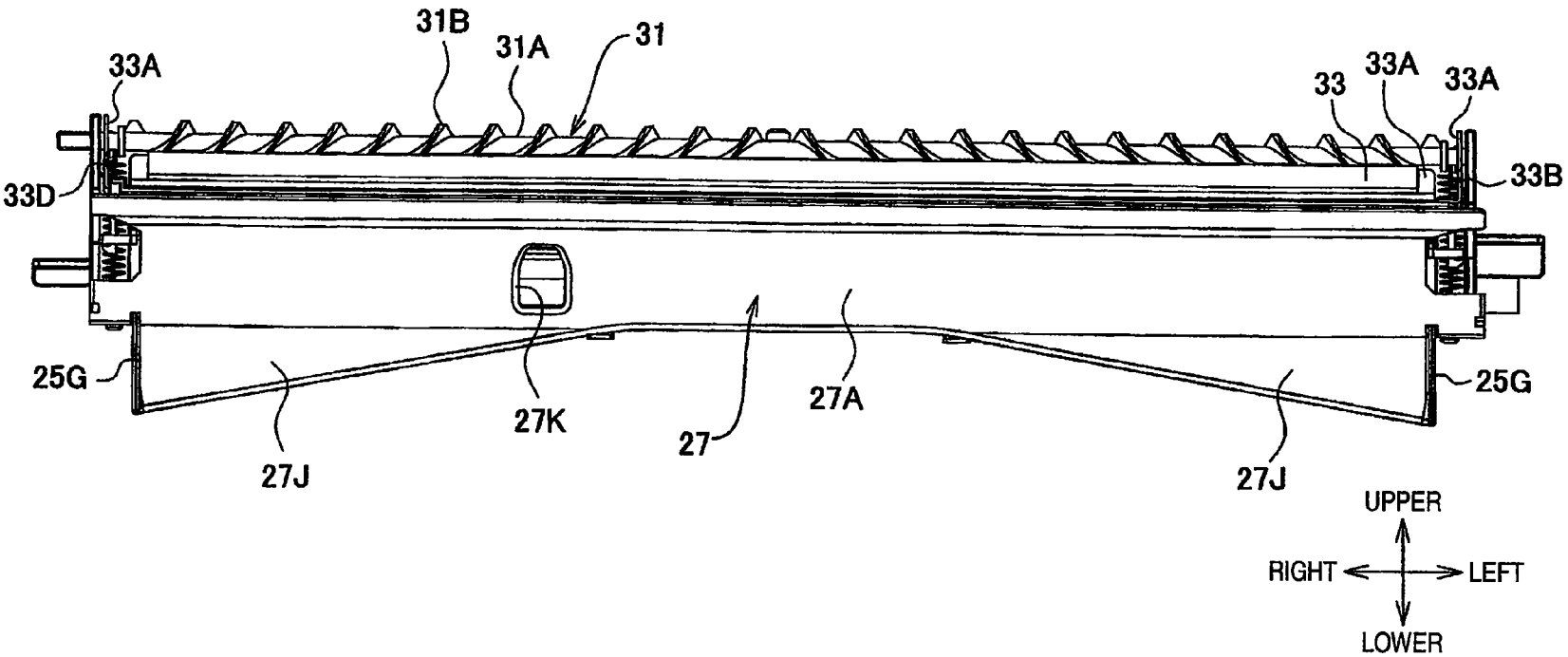
FIG. 7 is a rear view of the sheet feed unit according to the illustrative embodiment of the present invention when viewed from an image forming unit side.
Figure 9:
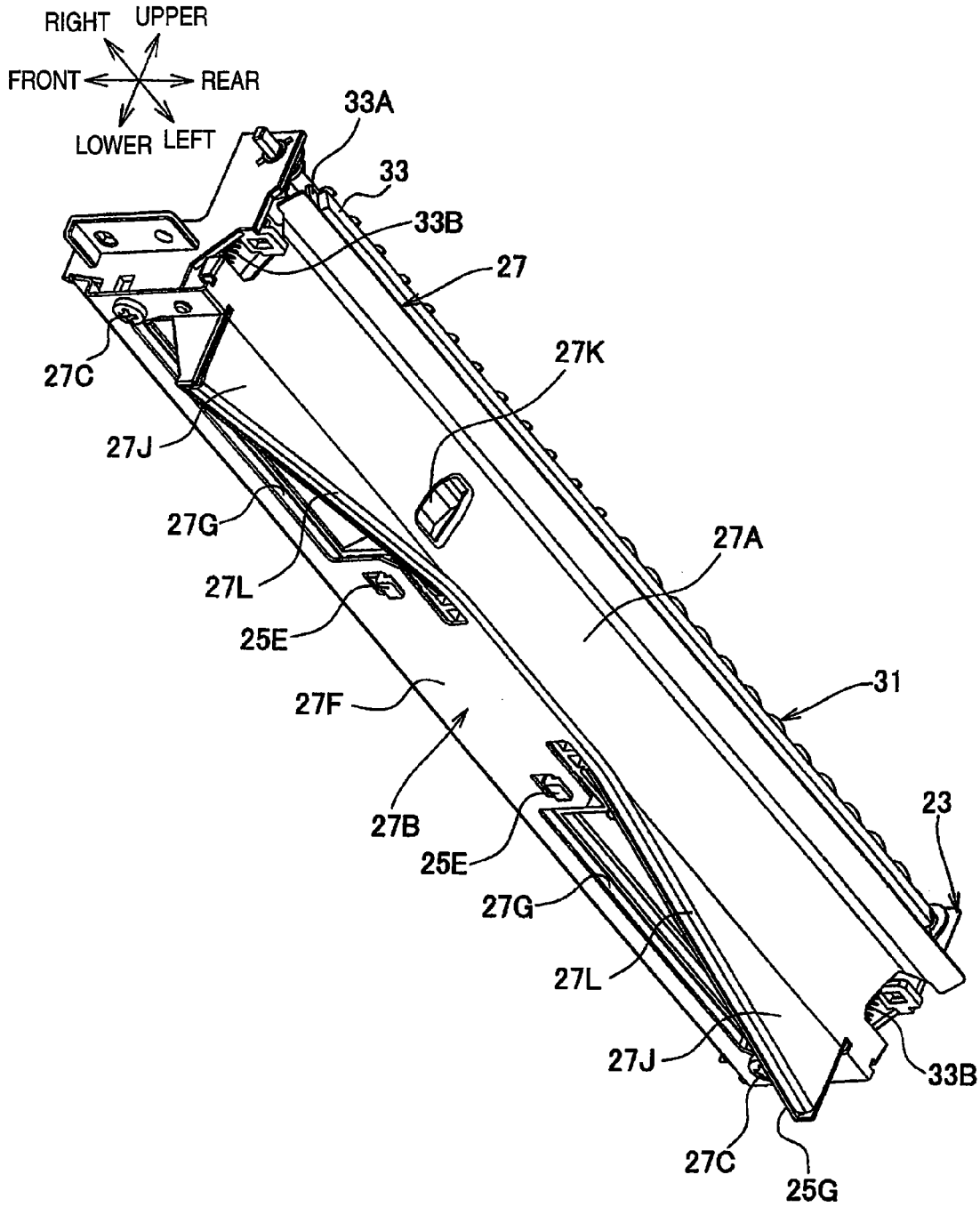
FIG. 9 is a perspective view of the sheet feed unit according to the illustrative embodiment of the present invention when viewed from a lower part on the image forming unit side.

As shown in FIGS. 7 and 9, the paper dust removing portion 33 extends over the entire region in the width direction to contact the pinch roller 16D, and is fixed to a metallic holding member 33A (see FIG. 10) by a double-sided tape or an adhesive. The holding member 33A holds the paper dust removing portion 33 in a state where the paper dust removing portion 33 is displacable with respect to the pinch roller 16D.

Figure 17:
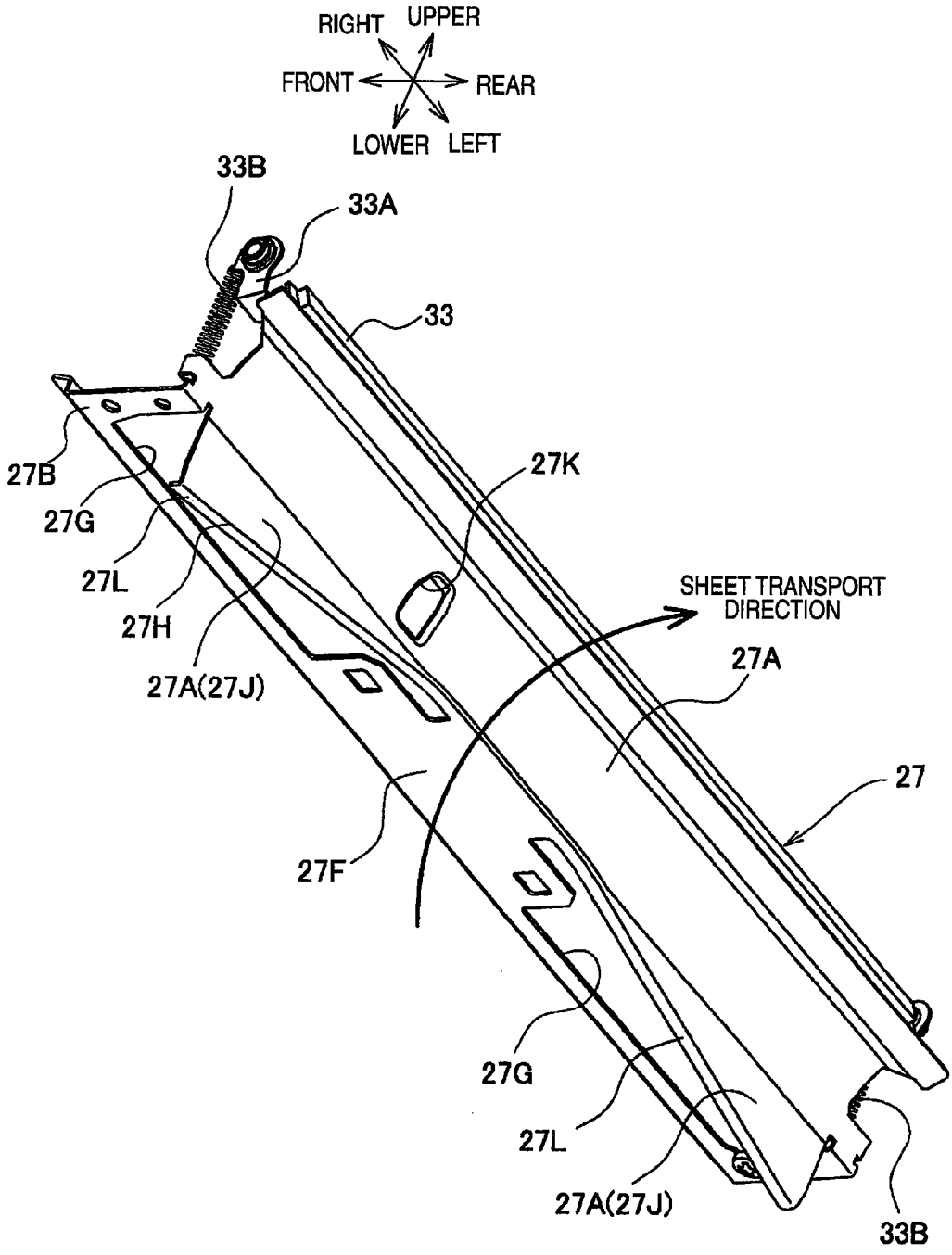
FIG. 17 is a perspective view of the transport chute according to the illustrative embodiment of the present invention when viewed from a lower part on the image forming unit side.

As shown in FIGS. 17 and 19, the holding member 33A is rotatably held by the rotation shaft 31A of the auger 31 and receives an elastic force from a metallic coil spring 33B in a direction in which the paper dust removing portion 33 is displaced toward the pinch roller 16D. One end of the coil spring 33B is engaged with the holding member 33A, and the other end of the coil spring 33B is engaged with the transport chute 27.

Accordingly, the paper dust removing portion 33 is configured to constantly contact the peripheral surface of the pinch roller 16D by a predetermined contact surface pressure. Therefore, paper dust collected to the pinch roller 16D can be reliably scraped, and the charges on the paper dust removing portion 33 and the like can escape to the ground through the spring 33B and the transport chute 27.

2.2. Configuration of Transport Chute

As shown in FIG. 10, the transport chute 27 includes the guide part 27A, a reinforcing frame 27B and the like. The guide part 27A is bent to follow the upright portion 25C to guide a sheet being transported from the sheet feed cassette 15 toward the image forming unit 5 (registration roller 16B). The reinforcing frame 27B extends in a direction intersecting the sheet guide direction by the guide part 27A so as to be mounted on the lower side of the horizontal portion 25D.

Figure 8:
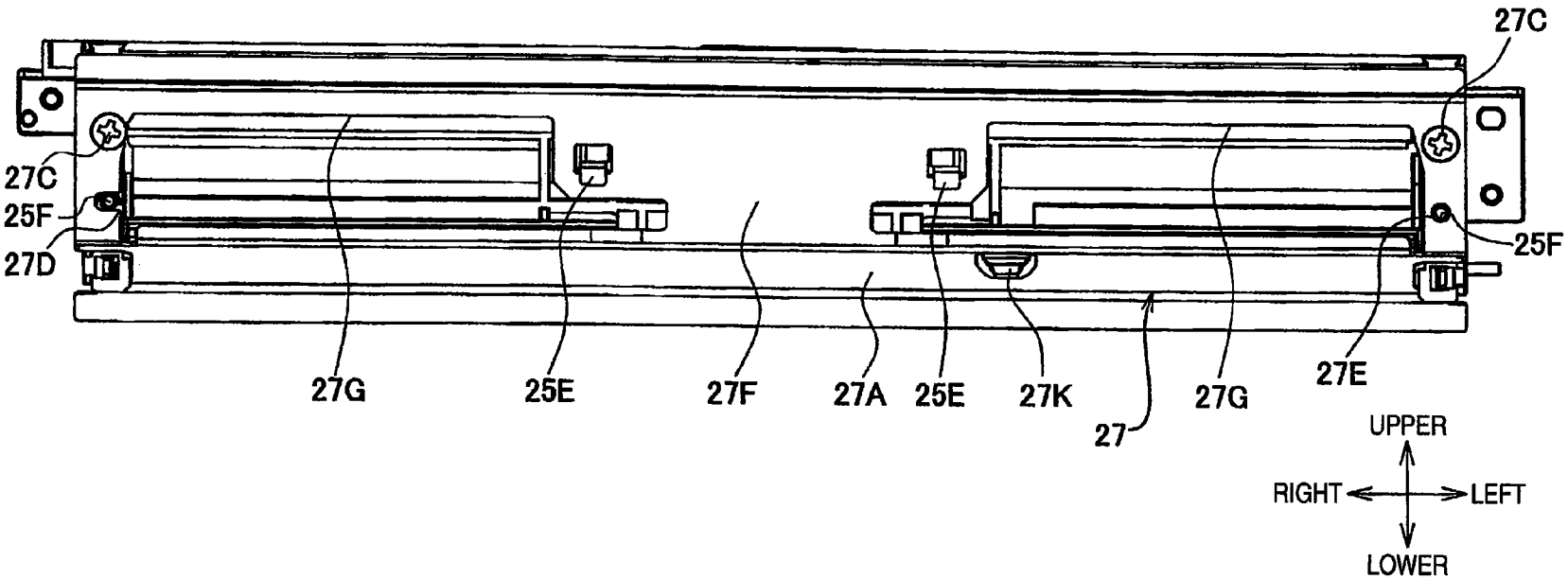
FIG. 8 is a bottom view of the sheet feed unit according to the illustrative embodiment of the present invention.

The reinforcing frame 27B is positioned on a side opposite to the separation pad 21D with the horizontal portion 25D interposed therebetween to receive the pressing force F together with the support frame 25 (beam portion 25A). In other words, the reinforcing frame 27B is mounted on the horizontal portion 25D from a side opposite to the separation pad 21D. As shown in FIGS. 8 and 9, the transport chute 27 is fixed integrally to the support frame 25 through the reinforcing frame 27B.

As shown in FIG. 8, the reinforcing frame 27B according to this illustrative embodiment is engaged with mechanical fastening means, such as P screws 27C or the like, provided at both ends of the beam portion 25A in the longitudinal direction and an engagement protrusion 25E provided at the substantially center of the beam portion 25A in the longitudinal direction. Thus, the reinforcing frame 27B is fixed to the support frame 25.

Boss-like protrusions 25F are formed on the beam portion 25A and function as positioning means which are inserted into a cutout 27D and a hole 27E formed in the reinforcing frame 27B. The protrusions 25F are inserted into the cutout 27D and the hole 27E, such that the transport chute 27 is positioned with respect to the support frame 25.

The reinforcing frame 27B includes a pressing force receiving portion 27F and openings 27G. The pressing force receiving portion 27F is provided at a part corresponding to the separation pad 21D. The pressing force receiving portion 27F is formed with an engagement hole into which the engagement protrusion 25E is fitted. The openings 27G are provided on both sides in the width direction (left-right direction) with the pressing force receiving portion 27F interposed therebetween.

Figure 14:
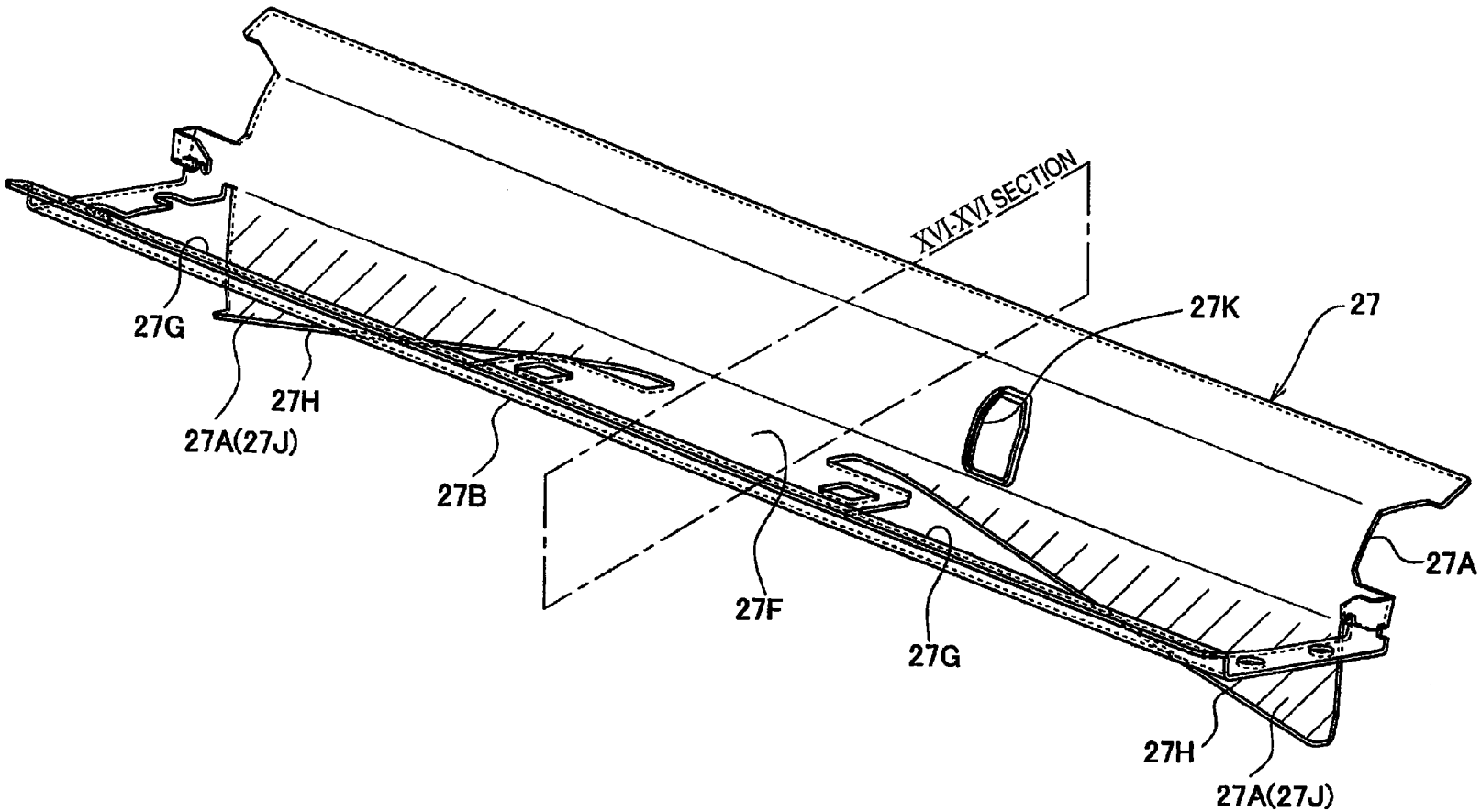
FIG. 14 is a perspective view of a transport chute according to the illustrative embodiment of the present invention.
Figure 16:
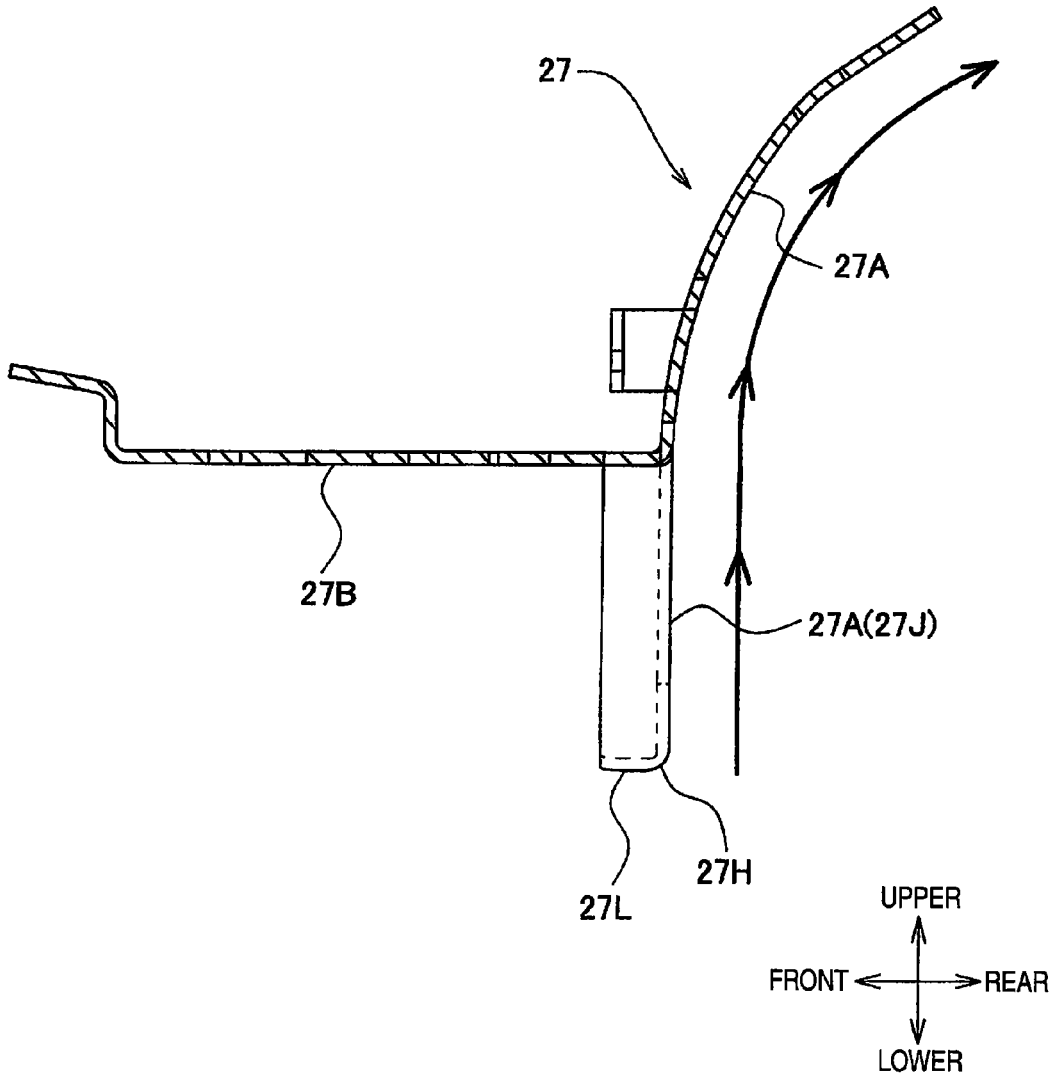
FIG. 16 is a sectional view of the transport chute according to the illustrative embodiment of the present invention taken along the line XVI-XVI of FIG. 14.

As shown in FIG. 16, the guide part 27A (transport chute 27) and the reinforcing frame 27B are formed integrally by pressing and bending a single metal plate member. As shown in FIG. 14, in the metal plate member, parts corresponding to the openings 27G are bent to form a part of the guide part 27A. Specifically, in FIG. 14, shaded portions 27J protrudes downward. Hereinafter, the shaded portions 27J are referred to as sheet introduction portions 27J.

Figure 15:
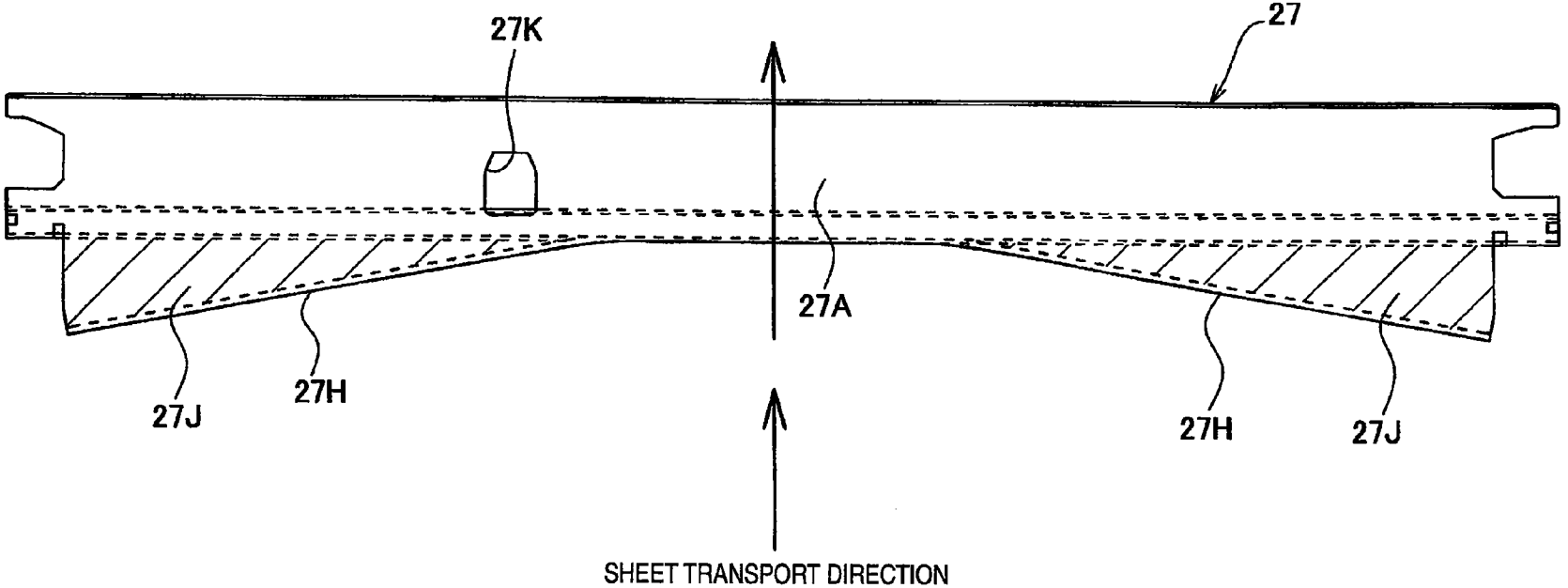
FIG. 15 is a diagram of the transport chute according to the illustrative embodiment of the present invention when viewed from the image forming unit side.

As shown in FIG. 15, both ends in the width direction of the transport direction upstream-side ends 27H of the guide part 27A, that is, the ends of the sheet introduction portions 27J, are inclined with respect to the transport direction when viewed from the thickness direction of a sheet being transported in the transport chute 27 (in this illustrative embodiment, a rear side). That is, an area of the guide part 27A (sheet introduction portions 27J) expands toward the both ends of the guide 27 from a center of the guide 27 in the width direction (left-right direction).

Figure 12:
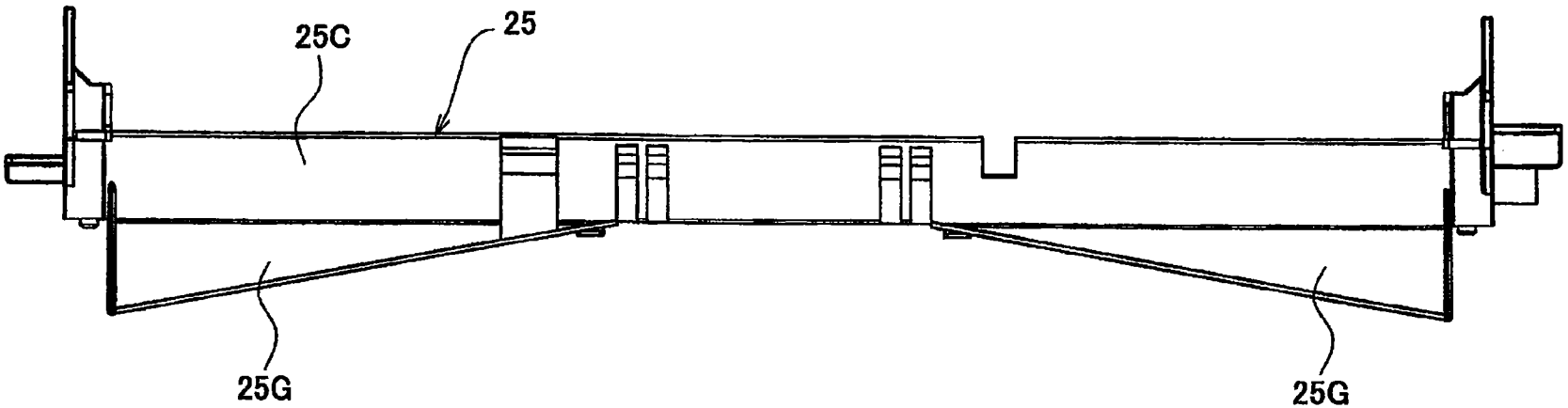
FIG. 12 is a rear view of the support frame according to the illustrative embodiment of the present invention when viewed from the image forming unit side.

Introduction parts 25G (see FIG. 12) are provided in the support frame 25 to correspond to the sheet introduction portions 27J. The guide part 27A is formed with a hole 27K (see FIG. 15), in which a sensor actuator for detecting a sheet is mounted.

Figure 18:
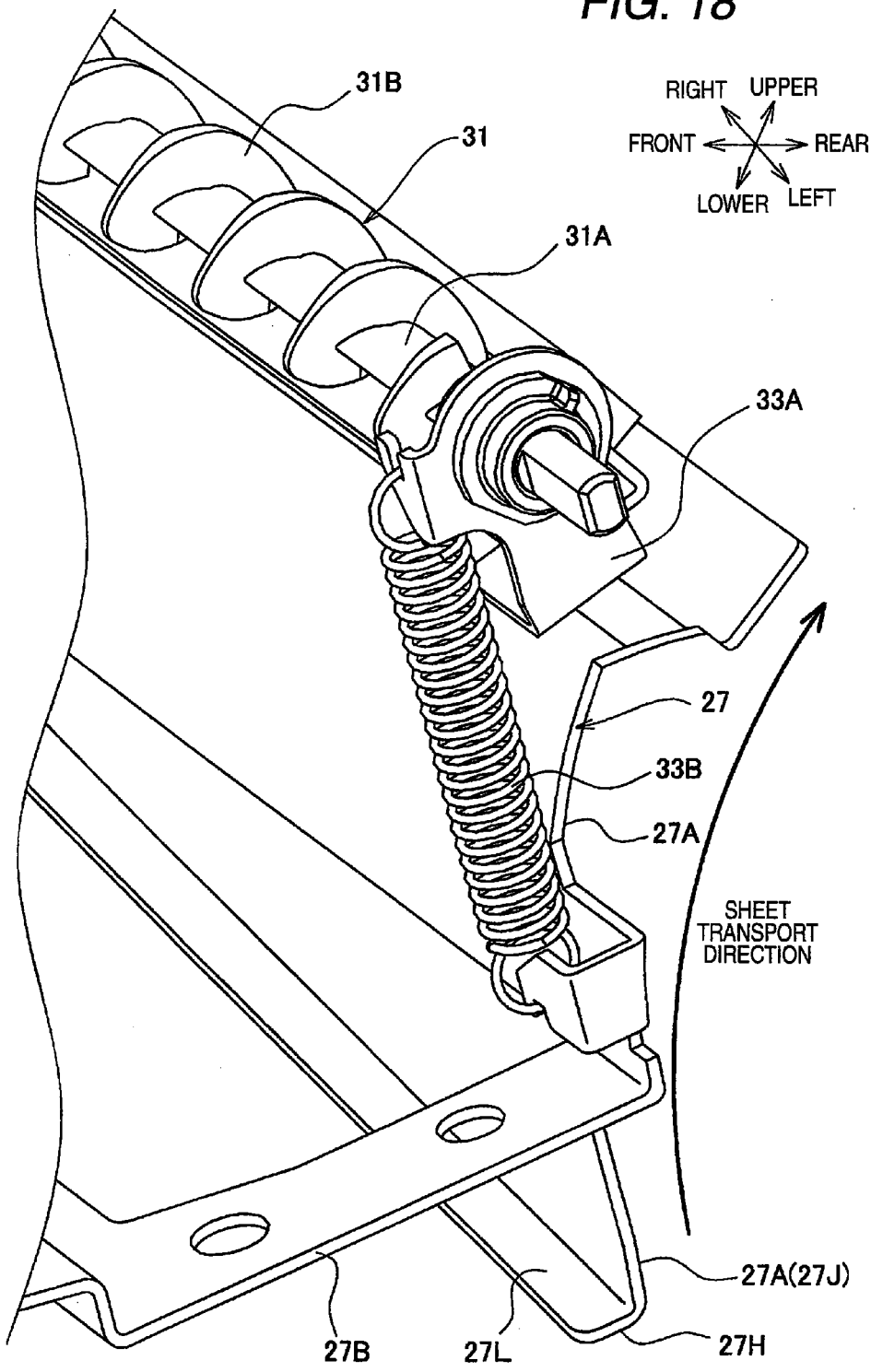
FIG. 18 is an enlarged perspective view showing an assembled state of the transport chute, a holding member, and a spring according to the illustrative embodiment of the present invention.

As shown in FIGS. 17 and 18, at the transport direction upstream-side ends 27H of the guide part 27A, bent portions 27L are formed to be bent toward a side opposite to the contact surface to the sheet (in this illustrative embodiment, the introduction part 25G side). The bent portions 27L are formed continuously over the entire region in the width direction.

In this illustrative embodiment, the sheet introduction portions 27J and the bent portions 27L are formed integrally by pressing a single metal plate member, similarly to the guide part 27A and the reinforcing frame 27B.

3. Effect of Image Forming Apparatus According to this Illustrative Embodiment

In this illustrative embodiment, the transport chute 27 including the guide part 27A for a sheet transported from the sheet feed cassette 15 is formed of metal, and the transport chute 27 is fixed integrally to the support frame 25. Thus, the guide part 27A functions as a reinforcing member which reinforces the support frame 25, and prevents the support frame 25 from being greatly bent.

Therefore, it is possible to suppress an increase in manufacturing cost of the support frame 25 (image forming apparatus 1) and also to prevent the separation and feed function from deteriorating, as compared with a case where the entire support frame 25 is formed of resin having high mechanical strength or the support frame 25 is formed of metal.

In this illustrative embodiment, the metallic reinforcing frame 27B is provided on the side opposite to the separation pad 21D with the support frame 25 interposed therebetween to receive the pressing force F together with the support frame 25, and the reinforcing frame 27B is formed integrally with the transport chute 27 (guide part 27A) by using metal. Thus, the support frame 25 is reinforced by two metallic members of the reinforcing frame 27B and the transport chute 27.

The reinforcing frame 27B and the transport chute 27 are integrally formed of metal, such that the support frame 25 can be strongly reinforced. Therefore, bending deformation of the support frame 25 can be reduced. As a result, the sheet separation and feed function by the separation roller 21B and the separation pad 21D can be reliably prevented from being deteriorated.

In the metal plate member, the parts corresponding to the openings 27G are bent to form the sheet introduction portions 27J. Thus, in the metal plate member, the parts corresponding to the openings 27G, that is, parts of the reinforcing frame 27B which are not likely to be involved in reinforcement of the support frame 25 are bent to form the sheet introduction portions 27J.

Therefore, in this illustrative embodiment, it is possible to secure the guide part 27A of a sufficient size and to form reinforcing frame 27B and the transport chute 27 by effectively using the metal plate member as material, while reducing the wasteful use of material.

In this illustrative embodiment, at the transport direction upstream-side ends 27H of the guide part 27A, the bent portions 27L are formed to be bent to the side opposite to the contact surface to the sheet. Thus, the transport direction upstream-side ends 27H of the guide part 27A have smoothly curved surfaces with no acute edge portions. Therefore, a sheet transported from the sheet feed cassette 15 can be smoothly guided to the image forming unit 5.

Since the bent portions 27L are formed, the bending rigidity of the guide part 27A increases. Therefore, the function of the transport chute 27 as a reinforcing member can increase, and bending deformation of the support frame 25 can be further reduced.

In this illustrative embodiment, the bent portions 27L are formed continuously over the entire region in the width direction, such that the bending rigidity of the guide part 27A further increases. Therefore, bending deformation of the support frame 25 can be reliably reduced.

In this illustrative embodiment, both ends in the width direction of the transport direction upstream-side ends 27H of the guide part 27A are inclined with respect to the transport direction when viewed from the thickness direction of the sheet being transported in the transport chute 27. Thus, the contact area between the sheet being transported and the guide part 27A is gradually expanded. Therefore, a rapid increase in the friction of the sheet can be suppressed, so the sheet can be smoothly transported.

In this illustrative embodiment, the guide part 27A (transport chute 27) is formed of metal. Thus, part of the transport chute 27 is electrically connected to the ground of the apparatus main body, such that the charges on the transport chute 27 and the paper dust removing portion 33 can easily escape. Therefore, an increase in the number of components can be suppressed, and the charges on the transport chute 27 and the paper dust removing portion 33 can be eliminated.

OTHER ILLUSTRATIVE EMBODIMENTS

While the present invention has been shown and described with reference to certain illustrative embodiments thereof, it will be understood by those skilled in the art that various changes in form and details may be made therein without departing from the spirit and scope of the invention as defined by the appended claims.

Although in the above-described illustrative embodiment, the reinforcing frame 27B and the guide part 27A (transport chute 27) are pressed and molded integrally, the present invention is not limited thereto. For example, the reinforcing frame 27B and the guide part 27A may be manufactured separately and integrated by welding or adhesion.

Although in the above-described illustrative embodiment, the reinforcing frame 27B is fixed to the beam portion 25A (horizontal portion 25D), so that the transport chute 27 (guide part 27A) and the support frame 25 are integrated, the present invention is not limited thereto. For example, the transport chute 27 may be integrated with the support frame 25.

Although in the above-described illustrative embodiment, the transport chute 27 and the support frame 25 are separately integrated, the present invention is not limited thereto. For example, the transport chute 27 and the support frame 25 may be integrated by insertion molding or the like.

Although in the above-described illustrative embodiment, the parts of the metal plate member are bent to form the sheet introduction portions 27J, the present invention is not limited thereto. That is, the sheet introduction portions 27J may be not formed.

Although the above-described illustrative embodiment, the electrophotographic image forming unit 5 is used, the present invention is not limited thereto. For example, an ink jet type image forming unit or the like may be used.

Although in the above-described illustrative embodiment, the direct tandem type image forming apparatus is used, the present invention is not limited thereto. For example, an intermediated transfer type or a monochrome type image forming apparatus may be used.

Although in the above-described illustrative embodiment, the exposure unit uses light-emitting diodes, the present invention is not limited thereto. For example, the exposure unit includes a laser configured to emit light and a mirror configured to reflect the light to perform exposure.

Although in the above-described illustrative embodiment, the separation roller 21 is used as a feed member, the present invention is not limited thereto. For example, a rotating member such as a belt may be used instead of the separation roller 21. Further, the separation pad 21D may be replaced by a roller or a belt as a friction member.

What is claimed is:

1. An image forming apparatus comprising:

an image forming unit which is configured to form an image on a recording sheet;

a housing which accommodates the image forming unit and includes a sheet feed opening for feeding a recording sheet to the image forming unit;

a tray which is configured to accommodate a recording sheet;

a feed member which is configured to rotate while pressing a recording sheet fed through the sheet feed opening to apply a transport force to the recording sheet;

a friction member provided to oppose the feed member, and configured to contact the recording sheet from a side opposite to the feed member to apply a transport resistance to the recording sheet, thereby separating a plurality of stacked recording sheets;

a support frame which is formed of resin and supports the friction member and extends in a direction substantially perpendicular to a pressing direction of a pressing force by the feed member to receive the pressing force;

a transport chute which is formed of metal and includes a guide part extending along a width direction of a recording sheet transported from the tray in a direction parallel to a longitudinal direction of the support frame so as to contact the recording sheet fed from the tray to guide the recording sheet toward the image forming unit; and a reinforcing frame which is formed of metal and is mounted on the support frame from a side opposite to the friction member and extends in parallel with the support frame.

2. The image forming apparatus according to claim 1, wherein a guide direction of a recording sheet by the guide part of the transport chute intersects a transport direction of a recording sheet by the feed member when viewed from the width direction of the recording sheet, and wherein the reinforcing frame is formed integrally with the transport chute.

3. The image forming apparatus according to claim 2, wherein the reinforcing frame includes a pressing force receiving portion provided at a part corresponding to the friction member, and openings provided on both sides in the width direction with the pressing force receiving portion interposed therebetween, and wherein the transport chute and the reinforcing frame are formed integrally by pressing and bending a single plate member, and parts of the plate member corresponding to the openings are bent to form at least a part of the guide part.

4. The image forming apparatus according to claim 1, wherein the guide part is formed with a bent portion at an upstream end thereof in a transport direction of the recording sheet fed from the tray, the bent portion being bent toward a side opposite to a surface of the guide part to contact with the recording sheet.

5. The image forming apparatus according to claim 4, wherein the bent portion is formed continuously over an entire region in the width direction.

6. The image forming apparatus according to claim 1, wherein an upstream end of the guide part in a transport direction of the sheet fed from the tray is inclined at both ends of the guide part in the width direction with respect to the transport direction when viewed from a thickness direction of the recording sheet transported in the transport chute.

7. The image forming apparatus according to claim 6, wherein an area of the guide part expands toward the both ends from a center thereof in the width direction.

* * * * *